US011655676B2

(12) United States Patent
Foley

(10) Patent No.: US 11,655,676 B2
(45) Date of Patent: May 23, 2023

(54) LADDER TRAY LOCKING MECHANISM

(71) Applicant: Tricam Industries, Inc., Eden Prairie, MN (US)

(72) Inventor: Joseph P. Foley, St. Paul, MN (US)

(73) Assignee: Tricam Industries, Inc., Eden Prairie, MN (US)

( * ) Notice: Subject to any disclaimer, the term of this patent is extended or adjusted under 35 U.S.C. 154(b) by 697 days.

(21) Appl. No.: 16/715,097

(22) Filed: Dec. 16, 2019

(65) Prior Publication Data

US 2020/0190905 A1 Jun. 18, 2020

Related U.S. Application Data

(60) Provisional application No. 62/779,633, filed on Dec. 14, 2018.

(51) Int. Cl.

| | |
|---|---|
| ***E06C 7/14*** | (2006.01) |
| ***E06C 7/16*** | (2006.01) |
| ***E06C 1/20*** | (2006.01) |
| ***E06C 1/39*** | (2006.01) |
| ***E06C 7/50*** | (2006.01) |
| ***E06C 7/48*** | (2006.01) |

(52) U.S. Cl.

CPC ..... *E06C 7/14* (2013.01); *E06C 1/20* (2013.01); *E06C 1/39* (2013.01); *E06C 7/16* (2013.01); *E06C 7/48* (2013.01); *E06C 7/50* (2013.01)

(58) Field of Classification Search

CPC ..... E06C 7/14; E06C 7/16; E06C 7/48; E06C 7/50; E06C 1/20; E06C 1/39; E06C 1/393; E06C 1/383

See application file for complete search history.

(56) References Cited

U.S. PATENT DOCUMENTS 3,625,388 A * 12/1971 Golden ..... E06C 7/14 220/570
3,744,591 A * 7/1973 Lucci ..... E06C 7/08 182/156
4,121,692 A * 10/1978 Morawski ..... E06C 7/16 182/129
4,862,994 A * 9/1989 Hughes, Sr. ..... E06C 7/14 248/238
5,052,581 A * 10/1991 Christ ..... E06C 7/14 220/570
5,613,574 A * 3/1997 Melanson ..... E06C 7/14 248/238
5,673,885 A * 10/1997 Pham ..... E06C 7/14 248/210
5,722,507 A * 3/1998 Kain ..... E06C 1/393 182/104
5,762,163 A * 6/1998 Kain ..... E06C 1/393 182/162
6,026,933 A * 2/2000 King ..... E06C 1/393 182/161
6,390,238 B1 * 5/2002 Gibson ..... E06C 1/387 182/161
6,427,805 B1 * 8/2002 Gibson ..... E06C 1/387 182/165

(Continued)

*Primary Examiner* — Brian D Mattei
*Assistant Examiner* — Kathleen M. McFarland

(57) ABSTRACT

A locking mechanism for a ladder tray is disclosed. The locking mechanism includes two locking points on the frame or handle of the ladder while allowing single-handed operation.

20 Claims, 7 Drawing Sheets

(56) References Cited

U.S. PATENT DOCUMENTS 6,443,260 B1 * 9/2002 Katz ..... E06C 7/14 248/238
6,454,050 B2 * 9/2002 Gibson ..... E06C 7/14 182/161
6,502,664 B1 * 1/2003 Peaker, Sr. ..... E06C 7/14 182/230
6,536,557 B2 * 3/2003 Gibson ..... E06C 7/14 182/161
6,550,579 B2 * 4/2003 Gibson ..... E06C 1/387 182/161
7,104,362 B2 * 9/2006 Meeker ..... E06C 7/50 182/161
7,108,103 B2 * 9/2006 Meeker ..... E06C 1/393 182/228.4
7,159,694 B2 * 1/2007 Gibson ..... E06C 1/393 182/161
7,182,176 B2 * 2/2007 Gibson ..... E06C 1/387 182/162
D600,820 S * 9/2009 Gomez ..... E06C 7/14 D25/68
7,849,967 B2 * 12/2010 Gibson ..... E06C 1/393 182/25
7,931,123 B2 * 4/2011 Moldthan ..... E06C 1/387 182/161
7,963,369 B2 * 6/2011 Parker ..... E06C 1/39 182/180.1
7,984,790 B2 * 7/2011 Meyers ..... E06C 1/393 182/163
8,186,481 B2 * 5/2012 Moss ..... E06C 7/50 182/25
8,684,139 B2 * 4/2014 Leng ..... E06C 1/387 182/20
9,163,455 B2 * 10/2015 Moss ..... E06C 7/50
9,309,718 B1 * 4/2016 Matthew ..... E06C 1/16
10,138,680 B2 * 11/2018 Williams ..... E06C 7/14
10,221,624 B2 * 3/2019 Leng ..... E06C 1/20
10,648,234 B2 * 5/2020 Skubic ..... E06C 1/393
2009/0078504 A1 * 3/2009 Astor ..... E06C 1/39 182/129
2011/0024234 A1 * 2/2011 Lin ..... E06C 1/387 182/161
2014/0054112 A1 * 2/2014 Astor ..... E06C 7/14 182/129
2020/0386050 A1 * 12/2020 Mittanck ..... E06C 7/50
2022/0195801 A1 * 6/2022 Gericke ..... E06C 7/14

* cited by examiner

LADDER TRAY LOCKING MECHANISM

CROSS-REFERENCE TO RELATED APPLICATION

The present application claims the benefit of U.S. Provisional Application No. 62/779,633, filed Dec. 14, 2018, which is hereby incorporated herein in its entirety by reference.

TECHNICAL FIELD

The present disclosure relates generally to a ladder. More particularly, the present invention relates to a locking mechanism for a ladder tray that provides a more secure locking of the ladder tray when in the open position and a more rigid tray while also simplifying operation of the locking mechanism.

BACKGROUND

Ladders and step stools are generally known in the art. Because of their desired portability, foldable step ladders often include handles and other features that make them easier to transport. Lucci, U.S. Pat. No. 3,744,591, discloses a portable, folding step ladder.

When working on a ladder or step stool, it is often desirable to have tools, paint, and other necessary objects within easy reach. For example, it is known to removably attach a paint roller tray to the rung of a ladder to more easily paint a ceiling or other area requiring a ladder or step stool. Golden, U.S. Pat. No. 3,625,388, discloses a paint tray particularly useful with an upright ladder.

Utility trays for use with ladders and step stools are also known in the art. Pham, U.S. Pat. No. 5,673,885, discloses a paint tray for a step ladder for storing work materials, tools and a paint bucket that is held onto the ladder by retaining means. Melanson, U.S. Pat. No. 5,613,574, discloses a ladder mounted tool holster and parts tray that removably clamps onto the top step of a step ladder. Katz et al., U.S. Pat. No. 6,443,260, discloses a step ladder tray pivotally attached to the top cap of a step ladder for supporting tools and the like. Christ et al., U.S. Pat. No. 5,052,581, discloses a detachable ladder support tray for supporting tools and 5 paint containers.

It is often inconvenient, however, to use a removable tool or paint tray with a ladder or step stool. In some instances, the tray may be difficult to attach or remove from the ladder or step stool depending on the configuration of the top cap of the ladder or step stool. The removable tray and ladder or step stool usually must be stored separately, taking up additional space. Additionally, to move a ladder or step stool from place to place, the tray may need to be removed and carried separately because of weight or awkward transport configuration.

Existing hinged ladder trays typically use links to provide both locking of the tray in the use position and to provide Astor, U.S. Patent Publication No. US20140054112, discloses a tray utilizing link mechanisms for locking the tray in the use position and providing support to the tray. However, the use of links, such as in Astor, requires two hands to simultaneously release the tray lock mechanism. Further, the use of links allows for potential pinching and takes up space beneath the tray.

There is a need in the industry to have a ladder tray locking mechanism that can simplify the operation of the tray while providing increased strength to both the lock and the tray.

SUMMARY OF THE INVENTION

The present invention is directed to an improved locking mechanism for a ladder tray. The locking mechanism provides a more secure locking of the tray when in the in use position. The mechanism also results in a more rigid tray when in the in use position. The locking mechanism provides dual locking of the tray to the frame or handle of the ladder with single-handed operation. Metal strike plates may also be provided to improve the alignment of the locking pins and protects the frame or handle from wear caused by repeated locking and unlocking of the tray. The design eliminates the need for hinges. The locking pins of the invention are located above the pivot, which eliminates the need for links to provide required strength. Other improvements include springs to bias the locking pins in the locked position and the stored position of the tray is below the handle of the ladder.

The above summary is not intended to describe each illustrated embodiment or every implementation of the subject matter hereof. The figures and the detailed description that follow more particularly exemplify various embodiments.

BRIEF DESCRIPTION OF THE DRAWINGS

The disclosure can be more completely understood in consideration of the following detailed description of various embodiments of the disclosure, in connection with the accompanying drawings, in which.

Figure 1:
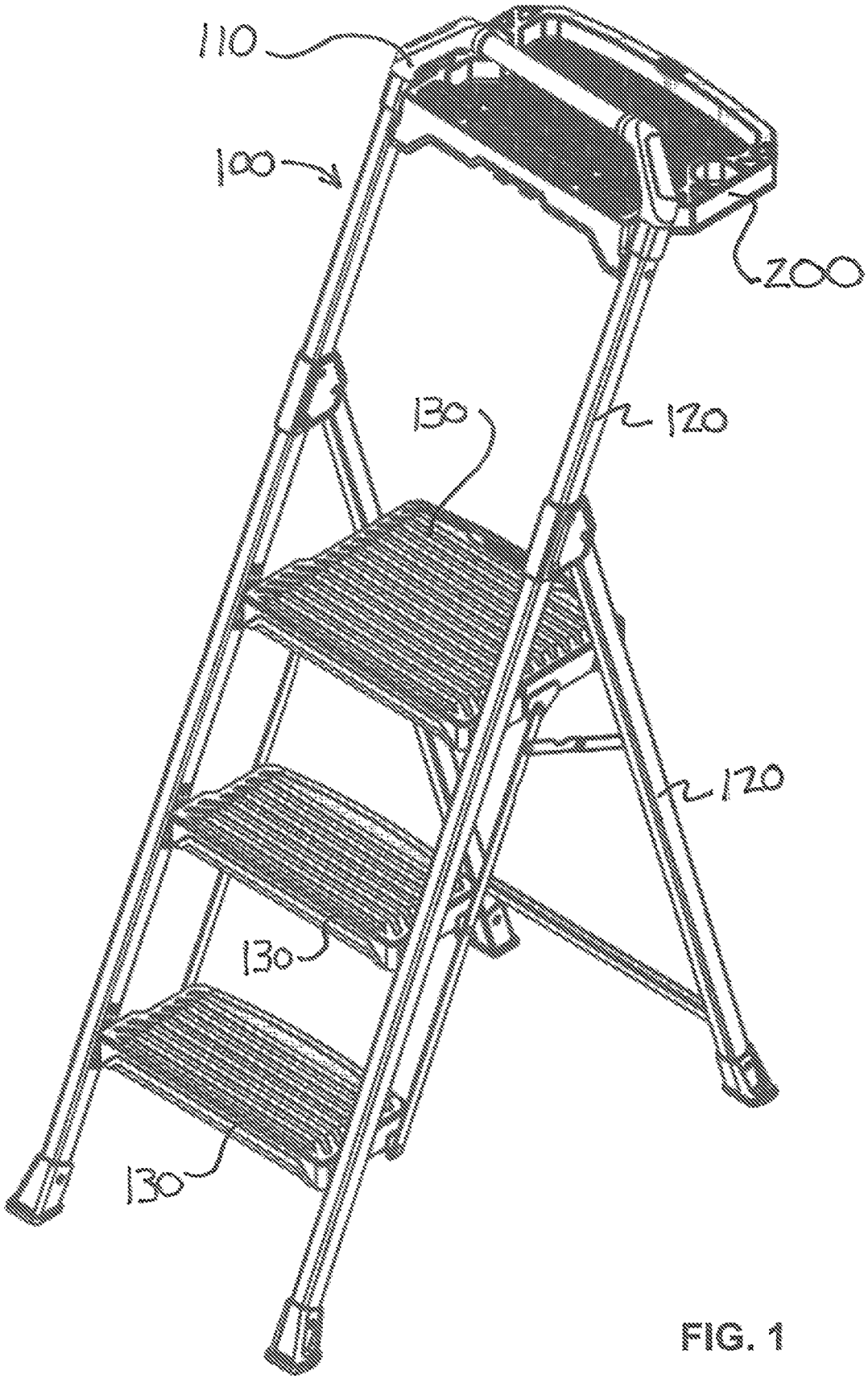
FIG. 1 is a front perspective view depicting a stepladder in accordance with an embodiment of the disclosure with the ladder tray in a use orientation.

While embodiments of the disclosure are amenable to various modifications and alternative forms, specifics thereof shown by way of example in the drawings will be described in detail. It should be understood, however, that the intention is not to limit the disclosure to the particular embodiments described. On the contrary, the intention is to cover all modifications, equivalents, and alternatives falling within the spirit and scope of the subject matter as defined by the claims.

DETAILED DESCRIPTION

Figure 2:
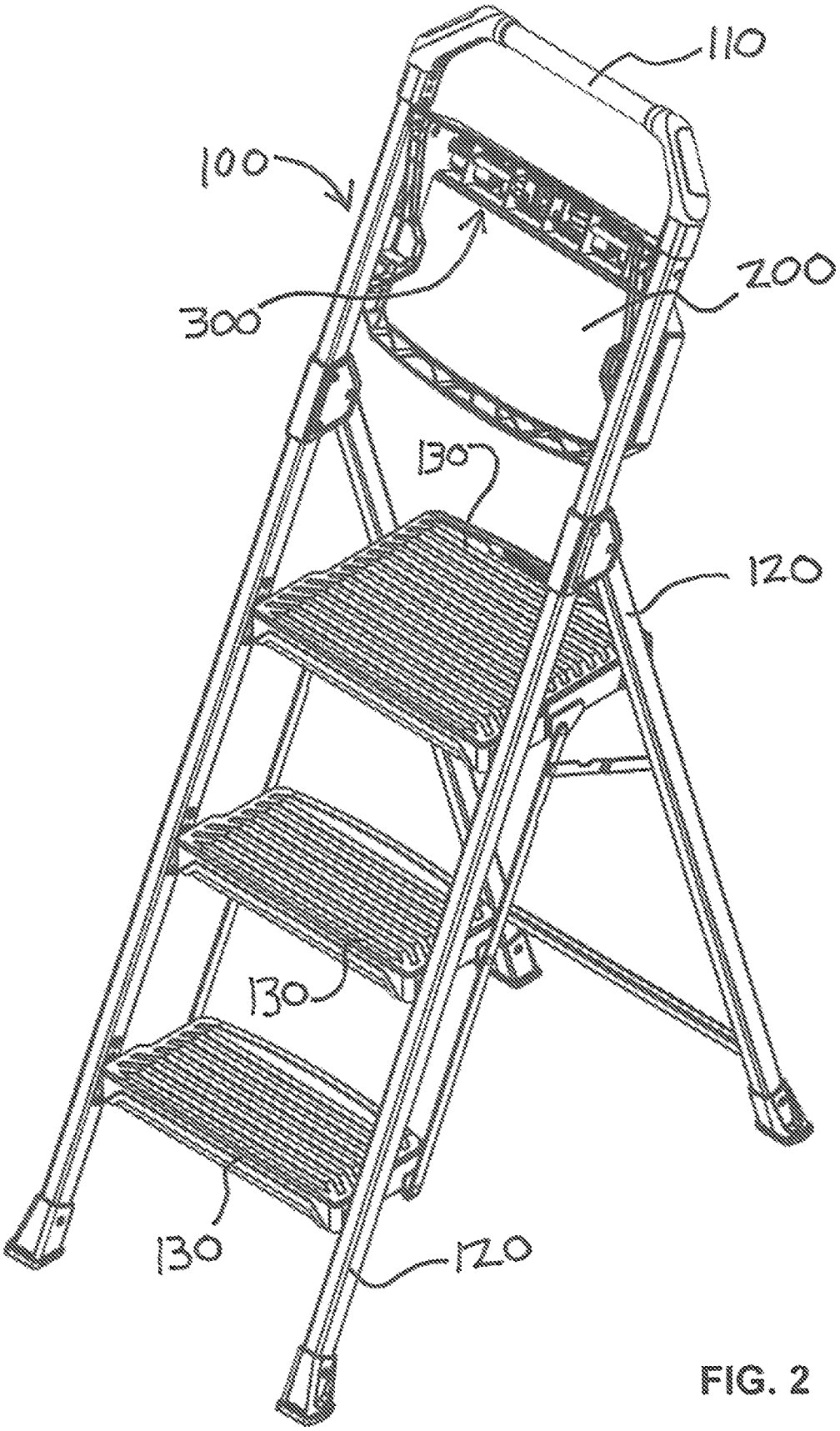
FIG. 2 is a front perspective view depicting the stepladder of FIG. 1 with the ladder tray in a stored orientation.
Figure 3:
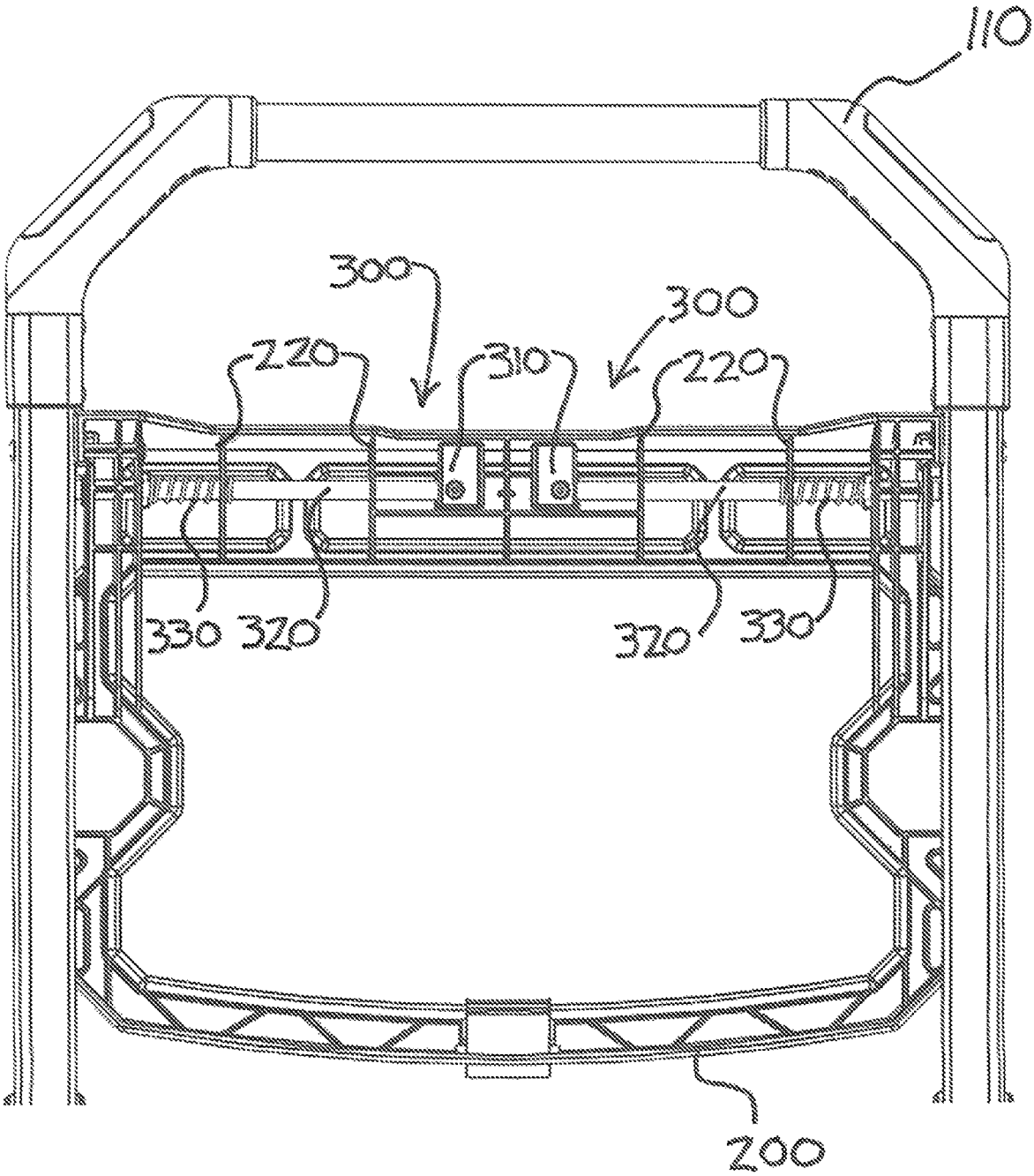
FIG. 3 is a front elevation view of the stepladder of FIG. 2.
Figure 4:
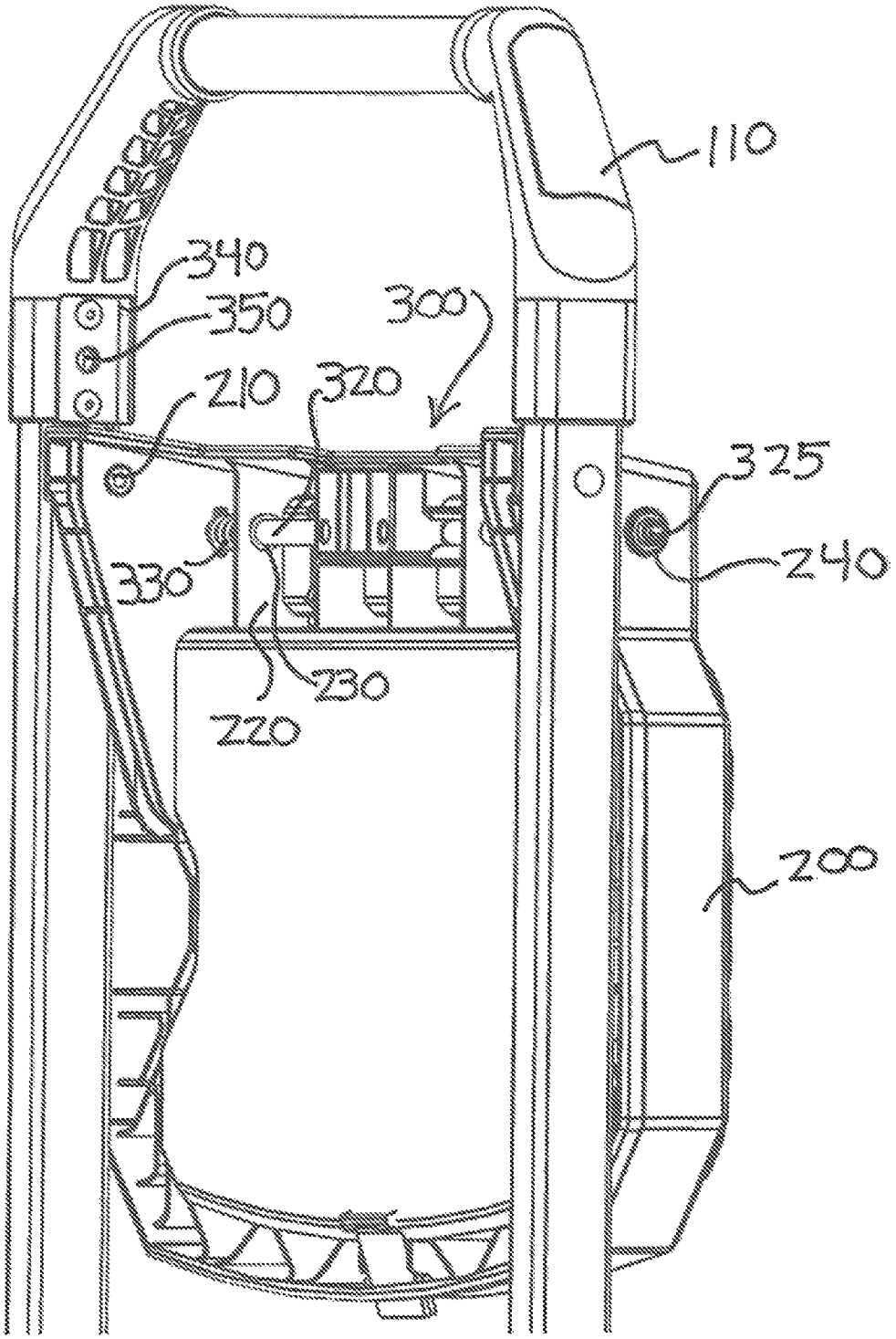
FIG. 4 is a right orthogonal view of the stepladder of FIG. 2.
Figure 5:
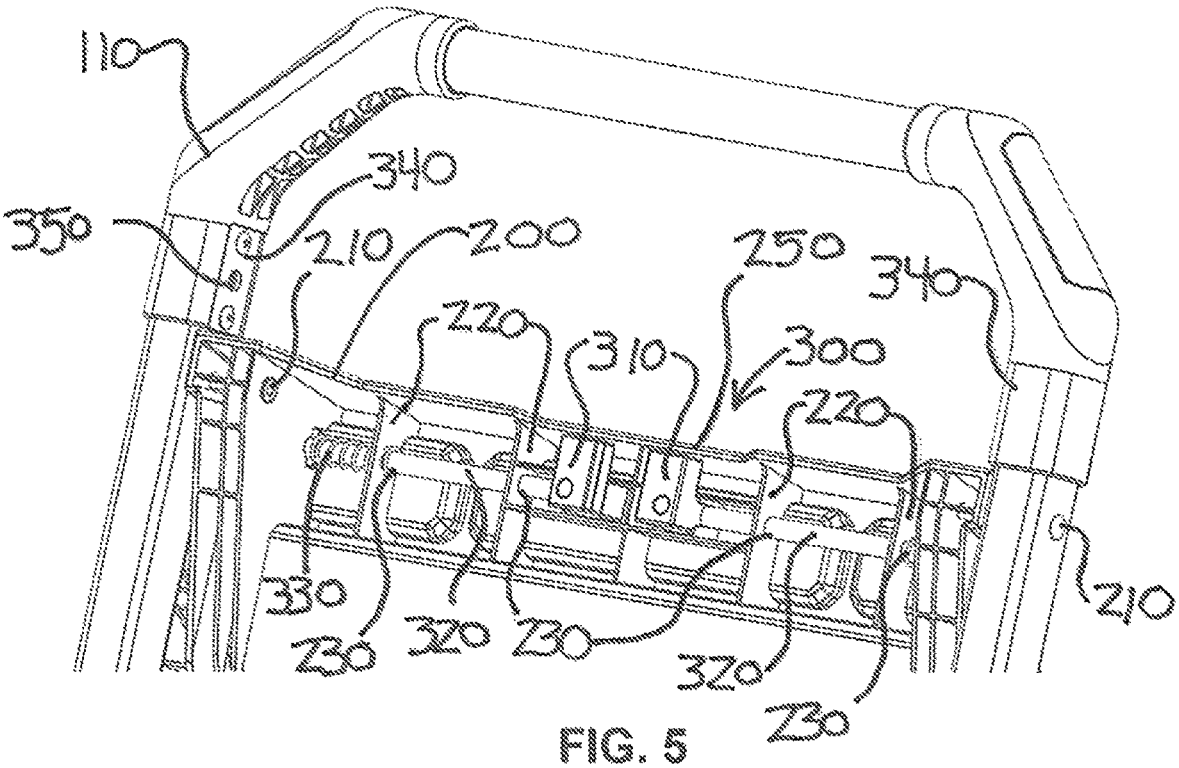
FIG. 5 is a right perspective view of the stepladder of FIG. 2.
Figure 6:
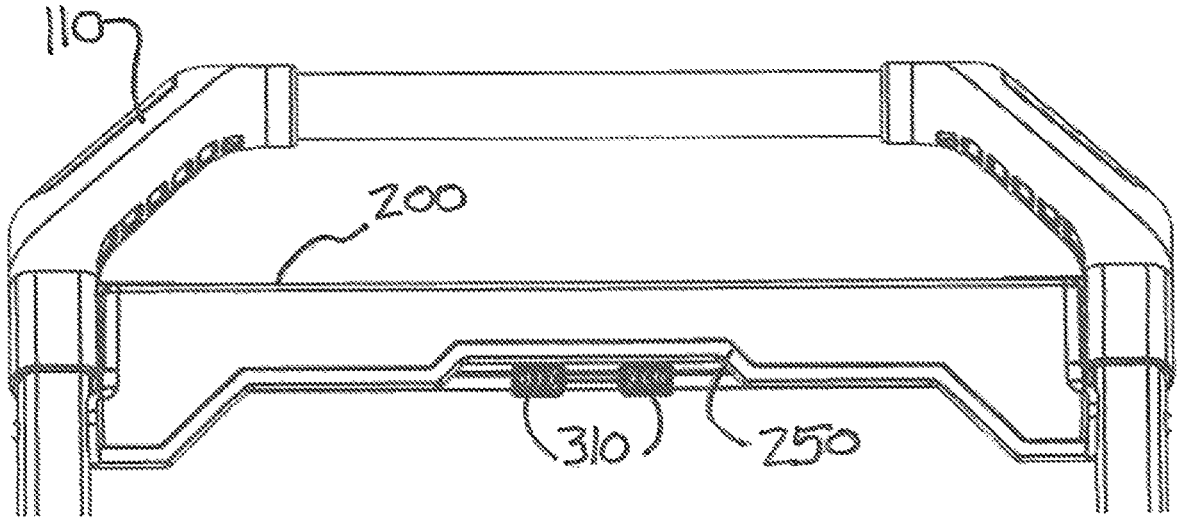
FIG. 6 is a front elevation view of the stepladder of FIG. 1.

A stepladder according to an embodiment of the invention is depicted in FIGS. 1-9 by reference numeral 100. Stepladder 100 has a handle 110 that extends above a ladder tray 200 that may be used to hold tools and materials while using stepladder 100. It is understood that in place of handle 110, the frame of stepladder 100 may simply extend above the ladder tray 200 and act as handle 110. Stepladder includes rails 120 and steps 130. Ladder tray 200 is pivotable between an open position as shown in FIG. 1 and a stored position as shown in FIG. 2.

Figure 7:
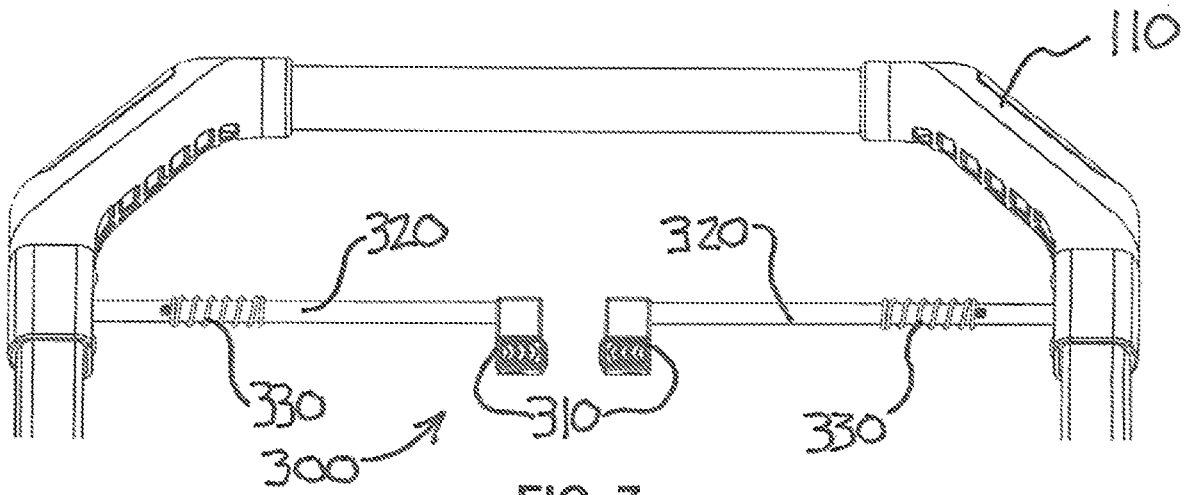
FIG. 7 is a front elevation view of the stepladder of FIG. 1 without the ladder tray.
Figure 8:
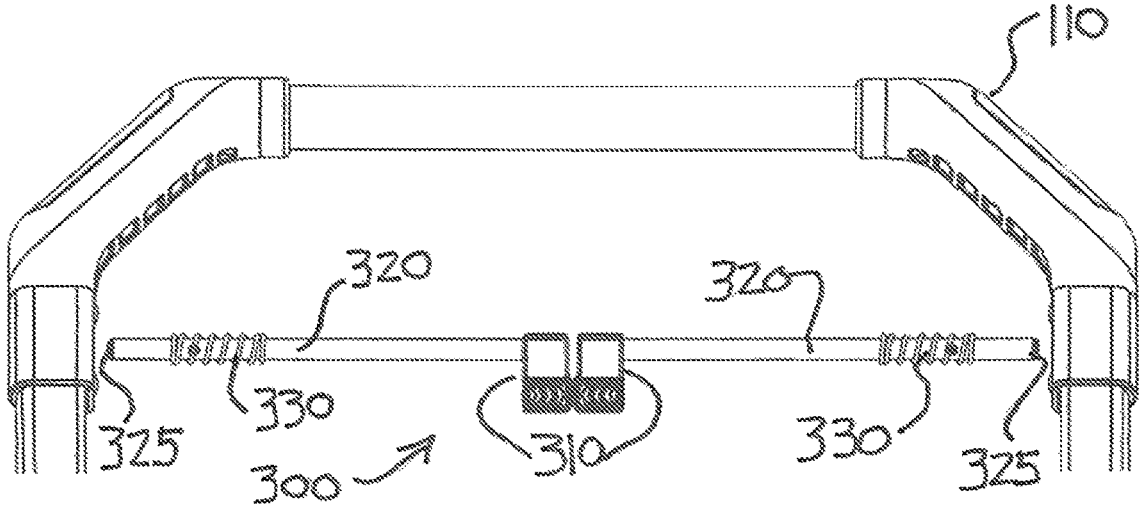
FIG. 8 is a front elevation view of the stepladder of FIG. 1 without the ladder tray and the ladder tray locking mechanism in the unlocked position.
Figure 9:
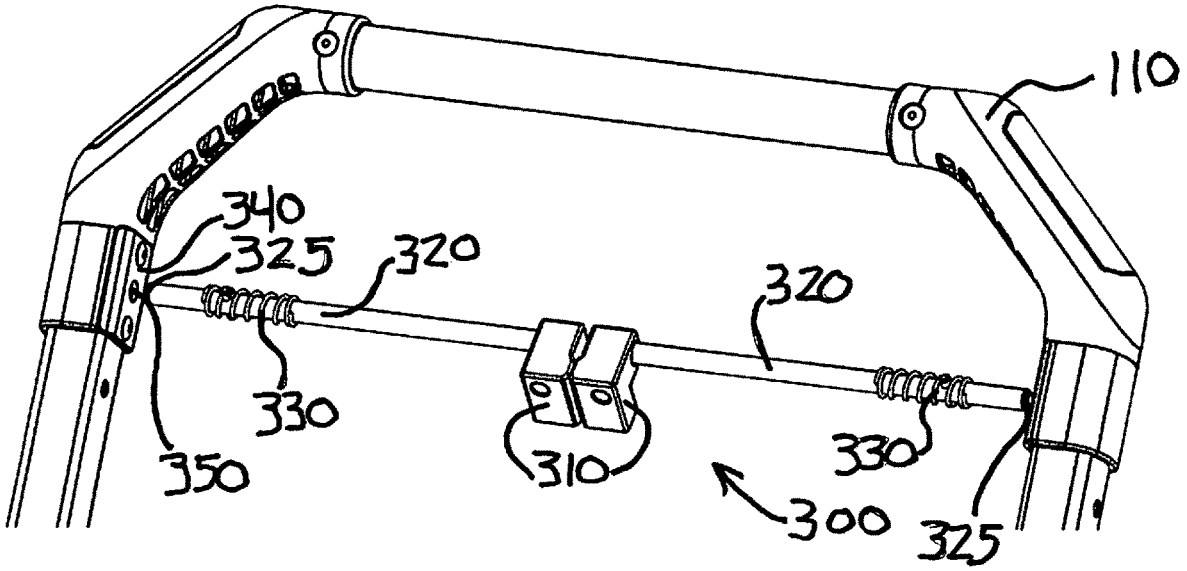
FIG. 9 is a right perspective view of the stepladder of FIG. 8.

The stepladder 100 of the present invention utilizes a novel locking mechanism 300 to keep ladder tray 200 in the open position. Locking mechanism 300 preferably has two sliding rods 320 that are biased by springs 330 to a locked position as shown in FIG. 7. Other means of biasing the rods in the locked position known in the art may also be used. Rod ends 325 are configured to slide into and out of handle orifices 350 on the handle 110. To improve performance of the locking mechanism 300 and prevent wear on the handle 110, locking mechanism may include strike plates 340. If strike plates 340 are used, it is understood that handle orifices would extend through the strike plates 340 to allow rod ends 325 to slide into and out of locking position.

Finger grips 310 are connected to rods 320 distal the rod ends 325. A user can press the finger grips 310 together to cause rod ends 325 to withdraw from handle orifices 350, and allow ladder tray 200 to be pivoted from the open position of FIG. 1 to the stored position of FIG. 2. Ladder tray 200 includes ribs 220 to provide strength and stiffness. Pivot pins 210, located below the handle orifices 350 connect the ladder tray 200 to the handle 110. Rods 320 run through rib orifices 230 to provide proper alignment of rods 320. Tray side orifices 240 allow rod ends 325 to extend outside of ladder tray 200 and traverse the handle orifices 350. Ladder tray 200 also provides a cutout 250 on the side facing a user to allow access to the finger grips 310.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

I claim:

1. A ladder, comprising:

a pair of rails;

a step;

a handle, the handle connecting the pair of rails and having two orifices;

a ladder tray pivotably connected to said handle by two pivot pins; and a locking mechanism comprising two rods, each rod having a rod end and a finger grip distal the rod end, each rod end configured to slide into and out of a respective handle orifice, the locking mechanism moveable from a locked position to an unlocked position;

wherein the handle orifices are located above the pivot pins.

2. The ladder of claim 1 wherein the ladder tray comprises ribs and rib orifices.

3. The ladder of claim 2 wherein each rod traverses at least one rib orifice.

4. The ladder of claim 3 wherein each rod further comprises a spring, the spring biasing the rod end to maintain the locking mechanism in a locked position.

5. The ladder of claim 1 wherein each rod further comprises a spring, the spring biasing the rod end to maintain the locking mechanism in a locked position.

6. The ladder of claim 4 wherein the handle comprises two strike plates.

7. The ladder of claim 6 wherein each strike plate comprises a strike plate orifice.

8. The ladder of claim 7 wherein each rod end is configured to slide into and out of a respective strike plate orifice.

9. A stepladder comprising:

a frame, the frame having two orifices;

a step;

a stepladder tray pivotably connected to said frame by two pivot pins, the stepladder tray pivotable from an open position to a stored position; and a locking mechanism comprising two rods, each rod having a rod end and a finger grip distal the rod end, each rod configured to slide into and out of a respective frame orifice;

wherein the frame orifices are located above the pivot pins.

10. The stepladder of claim 9 wherein each rod further comprises a spring, the spring biasing the rod end toward a respective frame orifice.

11. The stepladder of claim 10 wherein the frame comprises two strike plates.

12. The stepladder of claim 11 wherein each strike plate comprises a strike plate orifice.

13. The stepladder of claim 12 wherein each rod end is configured to slide into and out of a respective strike plate orifice.

14. The stepladder of claim 13 wherein the ladder tray comprises ribs and rib orifices.

15. The stepladder of claim 14 wherein each rod traverses at least one rib orifice.

16. A ladder tray comprising:

two pivot pins;

at least two ribs, each rib comprising a rib orifice; and a locking mechanism comprising two rods, each rod having a rod end and a finger grip distal the rod end, each rod end configured to slide into and out of a respective tray side orifice, the locking mechanism moveable from a locked position to an unlocked position;

wherein the ladder tray is pivotable from an open position to a stored position;

wherein the tray side orifices are located above the pivot pins when the tray is in the open position.

17. The ladder tray of claim 16 wherein each rod further comprises a spring, the spring biasing the rod end to maintain the locking mechanism in a locked position.

18. The ladder of claim 16 wherein each rod traverses at least one rib orifice.

19. The ladder of claim 17 wherein each rod traverses at least one rib orifice.

20. The ladder of claim 16 further comprising a tray cutout, the tray cutout proving access to the finger grips.

* * * * *